United States Patent [19]

Storie

[11] 4,070,006

[45] Jan. 24, 1978

[54] FENCE PRACTICE

[76] Inventor: Jack L. Storie, 3305 SW. 27th, Oklahoma City, Okla. 73108

[21] Appl. No.: 677,691

[22] Filed: Apr. 16, 1976

[51] Int. Cl.[2] ..... E04H 17/00

[52] U.S. Cl. ..... 256/1; 256/24

[58] Field of Search ..... 256/DIG. 2, 24, 25, 256/32, 34, 26

[56] References Cited

U.S. PATENT DOCUMENTS

| | | | |
|---|---|---|---|
| 2,594,410 | 4/1952 | Feldpausch | 256/25 |
| 2,599,967 | 6/1952 | Zimel | 256/24 |
| 2,646,800 | 7/1953 | Ratcliffe et al. | 403/104 |
| 2,805,046 | 9/1957 | Petterson | 256/25 |
| 2,873,951 | 2/1959 | Heffernan et al. | 256/25 |
| 3,166,299 | 1/1965 | DeChellis | 256/32 |
| 3,256,655 | 6/1966 | Teeter | 256/24 |
| 3,471,129 | 10/1969 | Mpakarakes | 256/24 |
| 3,713,625 | 1/1973 | Trudell | 256/34 |

FOREIGN PATENT DOCUMENTS

| | | | |
|---|---|---|---|
| 557,528 | 5/1958 | Canada | 256/24 |

*Primary Examiner*—Andrew V. Kundrat
*Attorney, Agent, or Firm*—Robert M. Hessin

[57] ABSTRACT

Apparatus for combinative use in conjunction with existing fences, particularly the woven mesh fence types, wherein the fence is given the capability of being raised manually in upward suspension for purposes of grass cutting, ground cultivation and the like immediately along the fence row. The apparatus embodies what may be termed conventional vertical upright posts disposed along the fence row to support the fencing material therealong, but in addition there is included a telescopic, slidable vertical sleeve and means for raising the vertical sleeve, attached fence and railing to a predetermined height for temporary affixure as required for ground maintenance.

6 Claims, 4 Drawing Figures

FENCE PRACTICE

BACKGROUND OF THE INVENTION

1. Field of the Invention

The invention relates generally to fencing structure and, more particularly, but not by way of limitation, it relates to an improved fence having adjustable height capabilities through relatively easy manipulation.

2. Description of the Prior Art

The prior art, of course, includes many and varied types of fence structure providing the time-honored segregation functions. There appears to be nothing in the prior art which is directed to a low cost, easily manipulable fence which can be raised and lowered for lawn cutting or other maintenance chores. A U.S. Pat. No. 2,873,951 in the name of Heffernan et al. is of some note in that it is directed to a fence lifting device; however, this patent is directed to a fluid driven type of hydraulic control system wherein applied fluid is controlled to raise and lower the fence. In this patent teaching, each vertical fence support member is in essence a hydraulic piston. U.S. Pat. No. 2,805,046 in the name of Petterson provides another fence adjustment teaching wherein spring-loaded subsurface structure is utilized to provide an upright fence having a collapsible capability.

SUMMARY OF THE INVENTION

The present invention contemplates improvements in fencing apparatus wherein existing fences can be easily altered by inclusion of additional structure, or original installation can be so constructed, to enable a fence having the capability of easy manipulation to an upraised temporary position for grass cutting and other maintenance chores. The fence structure includes the usual longitudinal stiffening members and fencing materials as supported by vertical upright members, which improved upright members are capable of manual telescopic adjustment for locking in an extended or upraised position.

Therefore, it is an object of the present invention to provide fence structure which is economical and easily adaptable into existing fence structure to enable the improved functions. It is also an object of the present invention to provide a simplified fence support structure having fence raising capability which may be easily handled by one person during the yard maintenance chores and the like.

Finally, it is an object of this invention to provide an adjustable height fence which is of reliable structure as well as low cost, and which provides a new degree of functional utility.

Other objects and advantages of the invention will be evident from the following detailed description when read in conjunction with the accompanying drawings which illustrate the invention.

DETAILED DESCRIPTION OF THE PREFERRED EMBODIMENT

Figure 1:
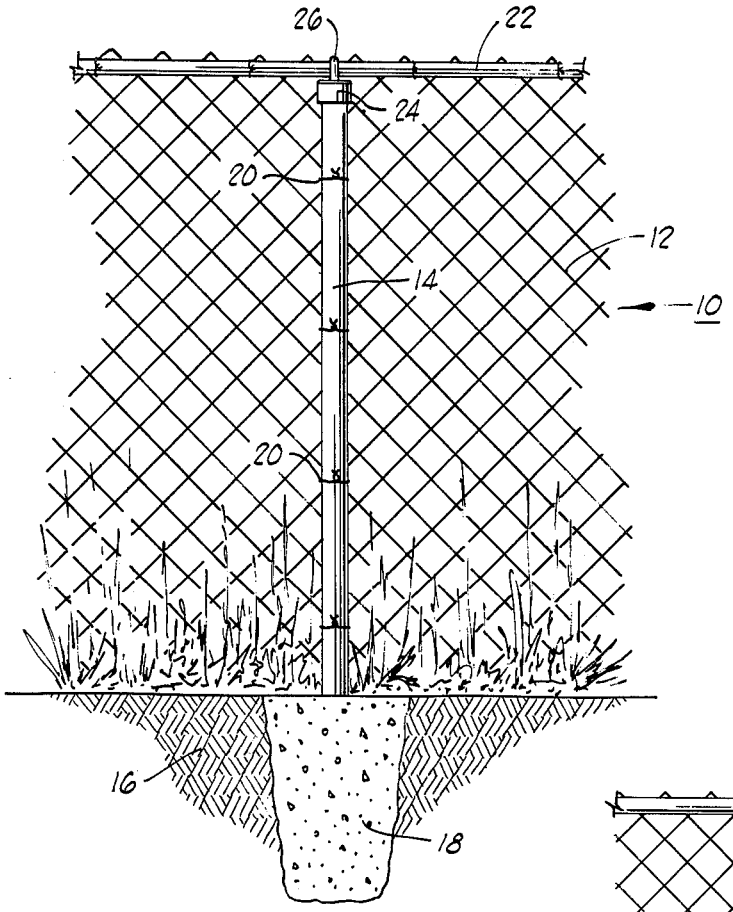
PRIOR ART FIG. 1
FIG. 1 is an elevational view of a well-known type of prior art fence structure.

Referring to FIG. 1, there is shown a well-known type of woven wire mesh fence 10 of the type long known in the prior art. The fence 10 consists of an expanse of woven wire mesh 12, commonly referred to as the CYCLONE type. Thus, mesh fence 12 is supported around or along an enclosure area by means of a plurality of vertical members 14 as suitably supported within earth 16, e.g., by means of cement 18. The wire mesh 12 is suitably affixed to the vertical member 14 by means of a plurality of wire clips 20, the number of wire clips 20 depending upon the height of fence 10.

As is well-known, such prior types of fences may be constructed in any of various heights, e.g., four, six or eight feet heights, and the diameter of pipe material in vertical member 14 will also vary in accordance with the structural requirements and height of fence 10. In any event, the upper or top border of fence 10 is stiffened by a plurality of longitudinal pipes 22 which are joined in end-to-end, swaged telescopic fit and supported on top of each vertical member 14 by means of a top cap 24 having a suitably sized eye 26 formed integrally therewith. The longitudinal members are then simply guided through the eye 26 of each top cap 24 around the fence perimeter.

Figure 2:
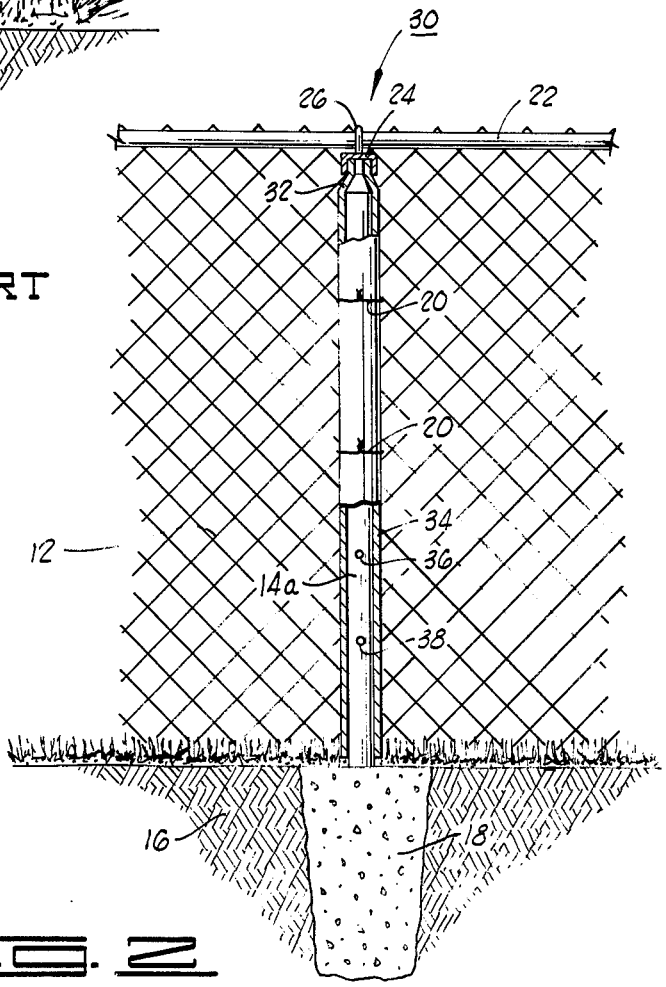
FIG. 2 is an elevational view in partial section of fence structure of the present invention.

FIG. 2 illustrates a section of fence 30 embodying the present invention. Fence 30 includes the similar top cap 24, eye structure 26 and longitudinal bar 22 as now placed for fit on an upper swaged end 32 of a vertical sleeve 34 extending down over the vertical member 14*a*. Vertical member 14*a* is shown similarly supported in earth 16 by means of cement 18, but there are drilled therein locking key holes 36 and 38 at a selected height above ground level. Similar tying of wire mesh 12 is effected by means of wire clips 20 disposed, as desired, upward along vertical sleeve 34.

Figure 3:
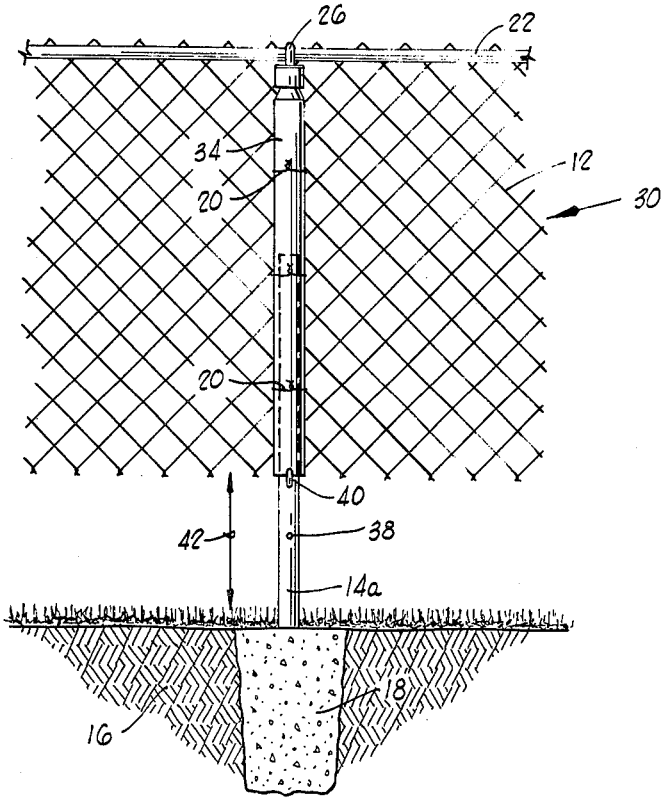
FIG. 3 is a side elevation of fence constructed in accordance with the present invention when in the upraised position.

As shown in FIG. 3, the fence 30 when in its upright or raised position may be retained in such position by means of an insertion key 40 inserted in a selected key hole 36 or 38. It is contemplated that insertion keys 40 for each vertical sleeve be retained thereon by means of a chain attachment or the like to guard against loss. While the key holes 36 and 38, or a greater number if desired, may be placed at any height, it has generally been found that a locking height of 18 inches from ground level, i.e., the dimension shown by arrow 42, is best located at 18 inches to allow easy manipulation of fence 30, yet more than adequate clearance for most lawn mowers and garden implements.

The present invention may be practiced either through original installation of adjustable height fence 30, or through modification of existing fence structures by the addition of vertical sleeves 34 having swaged upper ends 32 which receive top cap 24 thereover in reasonably tight, force fit. The vertical sleeve 34 may be of any suitable tubing material, preferably of a stock size having an inside diameter which may be selected for reasonably close telescopic fit with vertical upright member 14*a*.

Thus, for the case where an existing CYCLONE fence needs to be modified in accordance with the invention, referring again to FIGS. 1 and 2, it is only necessary to move along the fence and at each vertical upright 14 remove the wire clips 20, knock off top cap 24, and allow the expanse of wire mesh 12 and longitudinal bar 22 to rest over to one side. Thereafter, the swaged vertical sleeve 34 is placed down over vertical upright member 14*a* having key holes 36 and 38 drilled therein, and the wire mesh 12 can then be reclipped by wire clips 20 about vertical sleeve 34 while top cap 24 is once again of proper size to fit securely over swaged end 32 of vertical sleeve 34. Such fence modification can be carried out very rapidly and at a minimal cost per footage of fence.

Original installation of fence 30 would, of course, be carried out in much the same manner as the prior art types of CYCLONE fence 10, with the exception that vertical upright members 14*a* would be initially set with subsequent receiving of vertical sleeves 34 downward thereover to receive attachment of wire mesh 12 by means of wire clips 20.

Figure 4:
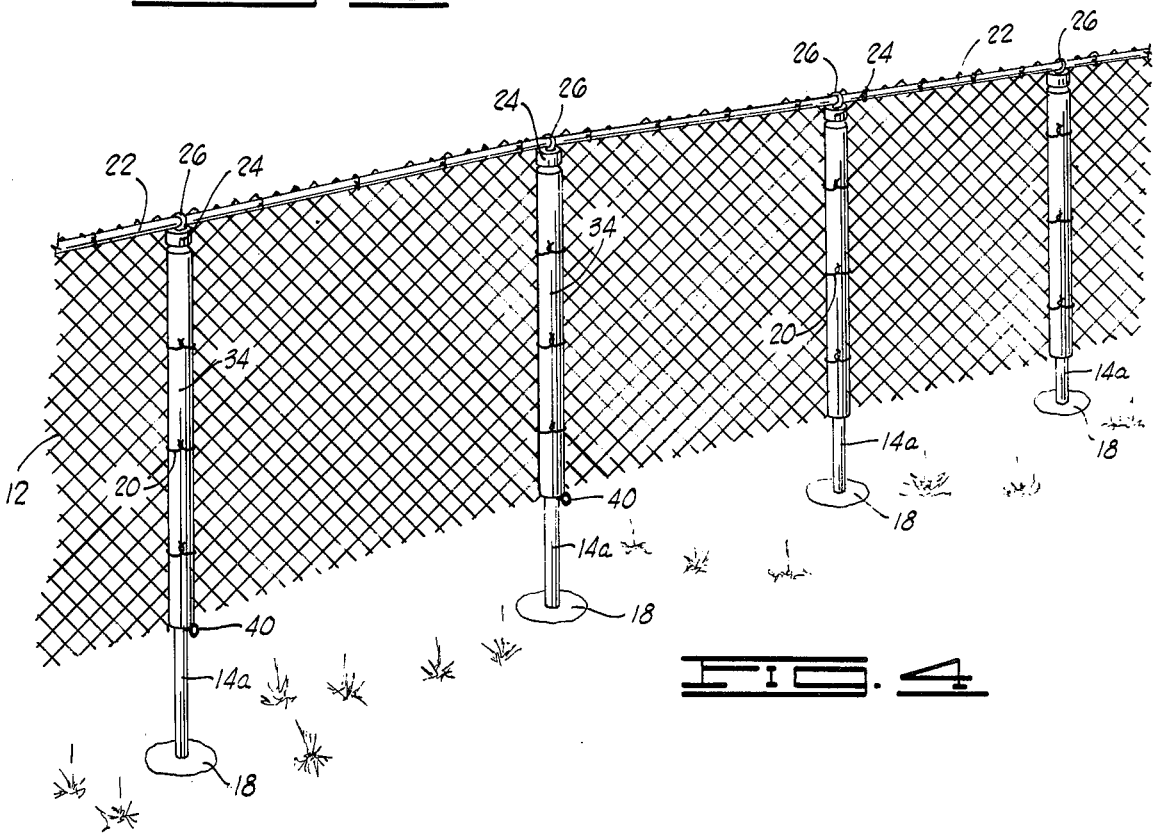
FIG. 4 is a perspective view of fence constructed in accordance with the present invention in the upraised and partially upraised position.

In operation, and with reference to FIGS. 2, 3 and 4 it has been found that the first fence section is the most difficult to raise. But the average man or even woman can well manage to raise the first section, e.g. starting from one corner of the fence enclosure, but they must use exertion. Thereafter, and as the lifter proceeds to successive vertical sleeves 34, the existing spring-like tension inherent in the wire mesh 12 actually serves as a lifting aid and very little exertion is necessary to raise and position each successive vertical sleeve 34 for pin retention by means of insertion key 40. After performance of the yard chores such as cutting grass or the like, it is only necessary for the attendant to go around the enclosure removing pins 40 and allowing each successive vertical sleeve 34 to fall downward over its associated vertical upright member 14*a* as the fence and wire mesh 12 naturally seeks it proper disposition under the force of gravity. It is even contemplated for fence-raising purposes, for the old, feeble or the like, to utilize a suitable jack or lever system for raising the first fence section, whereupon the remainder of the fence sections become increasingly easier to raise due to the natural spring-like stress imposed by the woven wire mesh 12.

The foregoing discloses novel fencing apparatus which readily allows changeover of existing fences as well as newly installed fences, and which provides an extremely low cost but highly useful fence structure wherein grass or cultivating earth along the fence row can be more easily attended. While the present invention has been particularly described with respect to certain types of woven wire mesh fence, it should be well understood that the similar principle can be utilized with many different types of fencing material to provide the requisite fence row access.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. An improvement in fence structure of the type having spaced vertical support members affixed to the earth's surface for the purpose of supporting a continuous expanse of fencing material along a preselected fence row, the improvement comprising:

a hollow elongated tubing member of greater cross-sectional area than said fence vertical support member and approximately the same length as said vertical support member for insertion downward thereover to receive said fencing material in secure affixure thereto, the uppermost end of said tubing being swaged to provide a reduced topmost outside diameter which is equal to the outside diameter of the topmost portion of said vertical support member;

top cap means having a lower opening of cross-sectional shape to be received securely downward on the upper swaged end of said tubing member, said top cap means having a retaining eye formed integrally therewith on the upper side thereof;

longitudinal bar means retained within said retaining eye along the uppermost portion of said fence structure; and means for locking the lower end of said tubing member at a preselected upper extremity of said vertical upright member after said tubing member has been raised to a preselected height.

2. An improved fence structure of the type which includes a plurality of vertical upright members secured within the earth's surface in spaced diposition along a designated fence row, a top cap adapted for force-fit retention on top of said vertical upright members and each including a retaining eye for retention of a longitudinal bar along the upper extremity of said fence for the extent of said designated fence row, and an expanse of fence material affixed to and supported along said fence row, the improvement comprising:

vertical sleeve members of slightly larger interior cross-sectional area than said vertical upright member and adapted to be inserted down over each of said vertical upright members in telescoping, slidable positioning, said vertical sleeve members each having a swaged upper end exposing an uppermost outer diameter adapted for force-fit within said top cap means;

means for securing said fence material to each of said vertical sleeve members; and means for retaining said vertical sleeve members in an upraised position relative to the earth's surface thereby to further support said fence material in an upraised position spaced from ground level, whereby lawn mowing, soil cultivation and the like can be carried out without interference of the fencing material.

3. An improvement structure as set forth in claim 2 wherein said means for supporting comprises:

at least one hole drilled within each of said vertical upright memfbers; and insertion key means adapted for insertion within said hole beneath the bottom of each of said vertical sleeve members to retain each of said sleeve members in its upraised position.

4. An improvement structure as set forth in claim 2 wherein said fence material comprises:

woven wire mesh fence material.

5. The method of rendering manually raisable to an upwardly suspended position, a fence of the type which includes, a plurality of vertical upright members secured in the earth surface along a fence row and an expanse of fence material disposed along and secured by wire clips to each of said vertical upright members, the steps comprising:

releasing said wire clips to free the expanse of fence material from each of said vertical upright members;

slidably disposing an elongated sleeve member down over each of said vertical upright members; and securing the fence material to each of said elongated sleeve members by said wire clips providing means for securing said sleeve members to their respective upright members at a preselected height in raised position.

6. The method of claim 5 which further includes the step of:

adapting a longitudinal fence stiffener member for secure affixure along the top of said fence material and the top most portion of said elongated sleeve members by swaging the top most portion of each elongated sleeve member so that its outside diameter is approximately equal to the outside diameter of said vertical upright members.

* * * * *